US009679727B2

(12) United States Patent
Takala et al.

(10) Patent No.: US 9,679,727 B2
(45) Date of Patent: Jun. 13, 2017

(54) SWITCH ASSEMBLY

(71) Applicant: ABB OY, Helsinki (FI)

(72) Inventors: Marko Takala, Vaasa (FI); Jari Elomaa, Vaasa (FI); Matti Kähkipuro, Hyvinkää (FI); Veikko Puumala, Kangasala (FI); Lauri Kettunen, Kangasala (FI); Tommi Forsberg, Nousiainen (FI); Pertti Arjanne, Tampere (FI); Mikko Helminen, Tampere (FI); Mikko Vehkaperä, Tampere (FI)

(73) Assignee: ABB OY (FI)

( * ) Notice: Subject to any disclaimer, the term of this patent is extended or adjusted under 35 U.S.C. 154(b) by 0 days.

(21) Appl. No.: 14/758,476

(22) PCT Filed: Dec. 28, 2012

(86) PCT No.: PCT/FI2012/051309
§ 371 (c)(1),
(2) Date: Jun. 29, 2015

(87) PCT Pub. No.: WO2014/102446
PCT Pub. Date: Jul. 3, 2014

(65) Prior Publication Data

US 2015/0340185 A1 Nov. 26, 2015

(51) Int. Cl.
*H01H 50/64* (2006.01)
*H01H 50/16* (2006.01)
(Continued)

(52) U.S. Cl.
CPC ..... *H01H 50/645* (2013.01); *H01H 3/222* (2013.01); *H01H 50/163* (2013.01);
(Continued)

(58) Field of Classification Search
CPC .. H01H 50/645; H01H 3/222; H01H 51/2209; H01H 50/163; H01H 50/443;
(Continued)

(56) References Cited

U.S. PATENT DOCUMENTS 2,163,559 A 6/1939 MacNeill
2,170,748 A * 8/1939 Webster ..... H01H 13/36 200/404
(Continued)

FOREIGN PATENT DOCUMENTS

CN 2036311 U 9/1989
CN 1489775 A 4/2004
(Continued)

OTHER PUBLICATIONS

National Board of Patents and Registration of Finland, International Search Report and Written Opinion issued in International Application No. PCT/FI2012/051309 mailed Sep. 25, 2013, 13 pp.
(Continued)

*Primary Examiner* — Mohamad Musleh
(74) *Attorney, Agent, or Firm* — Taft Stettinius & Hollister LLP

(57) ABSTRACT

A switch assembly (1) for switching electric circuits comprises a contributory switch (3), a main switch (2), and a flexible element (4). The contributory switch (3) and the main switch (2) are connected electrically in series, the contributory switch (3) and the main switch (4) each comprise at least one movable contact and the flexible element is connected to one movable contact of the contributory switch, a first contact (5*a*), and one movable contact of the main switch, a second contact (6*a*).

16 Claims, 3 Drawing Sheets

(51) Int. Cl.

| | |
|---|---|
| ***H01H 50/44*** | (2006.01) |
| ***H01H 50/54*** | (2006.01) |
| ***H01H 3/22*** | (2006.01) |
| ***H01H 51/22*** | (2006.01) |
| *H01H 1/50* | (2006.01) |
| *H01H 9/38* | (2006.01) |

(52) U.S. Cl.
CPC ..... *H01H 50/443* (2013.01); *H01H 50/54* (2013.01); *H01H 51/2209* (2013.01); *H01H 1/50* (2013.01); *H01H 9/38* (2013.01); *H01H 2201/008* (2013.01)

(58) Field of Classification Search
CPC H01H 50/54; H01H 1/50; H01H 9/38; H01H 2201/008
See application file for complete search history.

(56) References Cited

U.S. PATENT DOCUMENTS 2,236,699 A * 4/1941 Riche ..... H01H 37/60 200/457
2,558,219 A * 6/1951 Kohl ..... H01H 5/18 200/408
2,852,639 A * 9/1958 Nelsen ..... H01H 50/30 29/622
2,919,324 A * 12/1959 Schuessler ..... H01H 51/12 335/126
3,123,698 A 3/1964 Waterton
3,364,329 A * 1/1968 Concelman ..... H01H 50/54 200/241
4,039,983 A 8/1977 Terracol et al.
4,142,166 A * 2/1979 Arnoux ..... H01H 51/2209 335/230
4,421,959 A * 12/1983 Chen ..... H01H 9/38 200/16 A
4,430,579 A * 2/1984 Wiktor ..... H01H 50/32 307/116
6,133,812 A * 10/2000 Magda ..... H01P 1/125 333/105
6,337,612 B1 * 1/2002 Kim ..... H01H 51/2209 335/229
2004/0027776 A1 2/2004 Uotome et al.

FOREIGN PATENT DOCUMENTS

| | | |
|---|---|---|
| EP | 1353348 A1 | 10/2003 |
| FR | 2377087 A1 | 8/1978 |
| GB | 1576877 A | 10/1980 |

OTHER PUBLICATIONS

Finnish Patent and Registration Office, International Preliminary Report on Patentability issued in International Application No. PCT/FI2012/051309 dated Feb. 19, 2015, 8 pp.
Supplementary European Search Report, EP12691014, ABB Oy, Jul. 28, 2016, 5 pages.
Chinese Office Action, CN201280078048.3, ABB Oy, July. 13, 2016, 5 pages.
English Translation, Chinese Office Action, CN201280078048.3, ABB Oy, Jul. 13, 2016, 7 pages.

* cited by examiner

SWITCH ASSEMBLY

BACKGROUND

The present invention relates to a method and an assembly for switching electric circuits.

An oil circuit breaker is disclosed in U.S. Pat. No. 2,163,559, comprising circuit controlling devices enclosed by a cylindrical shell of insulating material and by end plates of conducting material. Relatively movable contacts of the circuit controlling devices are connected in series by means of flexible shunt conductors connecting the statutory contact of one device with the movable contact of the next adjacent device. A switch arrangement having a co-operating movable and stationary contact pair connected in series with at least one other such contact pair and a flexible conductor connecting the stationary contact of one pair to the movable contact of another pair is disclosed in U.S. Pat. No. 3,123,698.

BRIEF DESCRIPTION

An object of the present solution is thus to provide a new method and an assembly. The objects of the invention are achieved by a method and an assembly, which are characterized by what is stated in the independent claims. The preferred embodiments of the invention are disclosed in the dependent claims.

The solution is based on the idea that a contributory switch and a main switch are connected in series and a contact of the contributory switch a rid a contact of the main switch are connected to one another with the help of a flexible element.

An advantageous feature of the method and arrangement of the solution is that it is possible to arrange the mechanical movement related to the opening of the contributory switch to affect, at the same time, the opening of the main switch.

BRIEF DESCRIPTION OF THE DRAWINGS

In the following the solution will be described in greater detail by means of preferred embodiments with reference to the attached [accompanying] drawings, in which.

DETAILED DESCRIPTION

Figure 1:
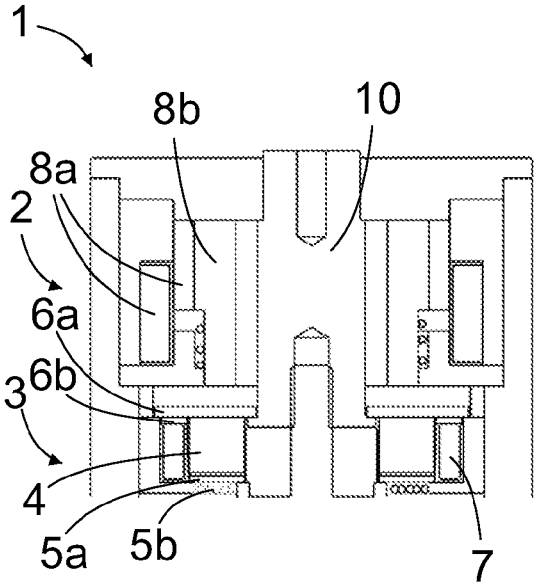
FIG. 1 is a schematic view of a switch assembly in a closed state.

FIG. 1 is a schematic cross-sectional view of a switch assembly 1 for switching current in an electric circuit, the switch assembly comprising at least a main switch 2 for switching the electric circuit of the switch assembly and a contributory switch 3 for switching the electric circuit of the switch assembly, wherein the main switch 2 and the contributory switch 3 are connected electrically in series, and a flexible element 4. The contributory switch 3 may comprise at least one movable contact, a first contact 5*a*, which is connected to the flexible element 4. The movable first contact 5*a* may, in a closed state of the contributory switch, provide a path for the current between connectors of the switch assembly, such as an inner connector 11 and a middle connector 9 in FIG. 3 or a main connector 10 and an inner connector 11 in FIG. 4, and in an open state of the contributory switch disconnect this path for the current. According to an embodiment, the first contact 5*a* may be arranged to the flexible element 4 fixedly, such as attached with an adhesive substance. The functionality and structural and operational alternatives of such a contributory switch are explained in more detail later in this description. The form of the transverse cross section of the switch assembly is not relevant for the functionality and can vary substantially in different embodiments, but in the embodiments shown in the FIGS. 1 to 4 most of the switch assembly parts are substantially annular extending around the main connector 10, which forms the core of these embodiments. Thus, the structure is substantially symmetrical and most of the parts are only numbered in one half for the sake of clarity.

The main switch 2 may comprise at least one movable contact, a second contact 6*a*, which is connected to the same flexible element as the first contact 5*a*, preferably at an opposite end of the flexible element 4. Thus, the flexible element connects the first contact 5*a* and the second contact 6*a* mechanically. According to an embodiment, the second contact 6*a* may be arranged ranged to the flexible element 4 fixedly, such as attached with an adhesive substance. The movable second contact 6*a* may, in a closed state of the main switch, provide a path for the current between connectors of the switch assembly, such as a middle connector 9 and a main connector 10 in FIG. 3 or a main connector 10 and an inner connector 11 in FIG. 4, and in an open state of the main switch disconnect this path for the current. Contact pressure between contacts of the contributory switch during a closed state of the switch assembly may be provided with a flexible element 4 arranged in a compressed state and connected to one contact of the contributory switch, more specifically the first contact 5*a*, and one contact of the main switch, more specifically the second contact 6*a*. Second contact 6*a*, which is thus a contact of the main switch, may be held in its position by force-providing means 7. In an embodiment, the force-providing means may be used for providing, in a closed state, a contact force for the second contact 6*a* of the main switch and a compressive force for the flexible element 4. In different embodiments, the force-providing means 7 may comprise at least one of the following: a permanent magnet and an electric magnet. In the embodiment according to FIG. 1, the force-providing means comprise at least one permanent magnet 7 for holding the contact of the main switch, more specifically the second contact 6*a*, in position. The permanent magnet may be static and the second contact 6*a* of the main switch may comprise an iron disc 6*b* attracted by the force-providing means 7 thus holding the second contact 6*a* in place when the switch is closed.

A magnetic circuit comprising a linear actuator 8, such as a solenoid actuator, can be used for enabling switching the main switch from open to closed state and, thus, compressing the flexible element 4. A solenoid actuator, for example, may comprise a static part 8*a* and an armature 8*b* for affecting the second contact 6*a*. Preferably, the solenoid actuator may be spring returned to avoid unnecessary moving masses. In other embodiments, the linear actuator may comprise any member or arrangement that is able to provide the needed force and this short linear mechanical movement, such as a screw and motor arrangement, a compressed medium, cylinder, such as a pneumatic cylinder, a camshaft or even a manually operated lever, for example. The FIG. 1 shows a switch assembly in a state, wherein the contributory switch 3 and main switch 2 are both closed.

Figure 2A:
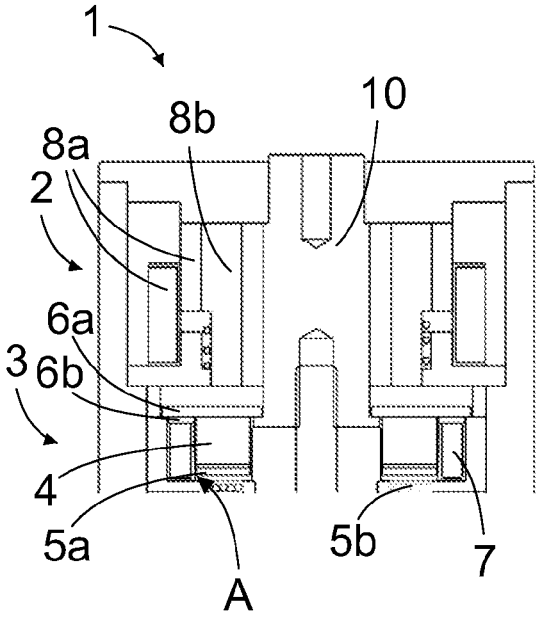
FIGS. 2*a*, 2*b* and 2*c* are schematic views of a switch assembly in other operational states thereof.
Figure 2B:
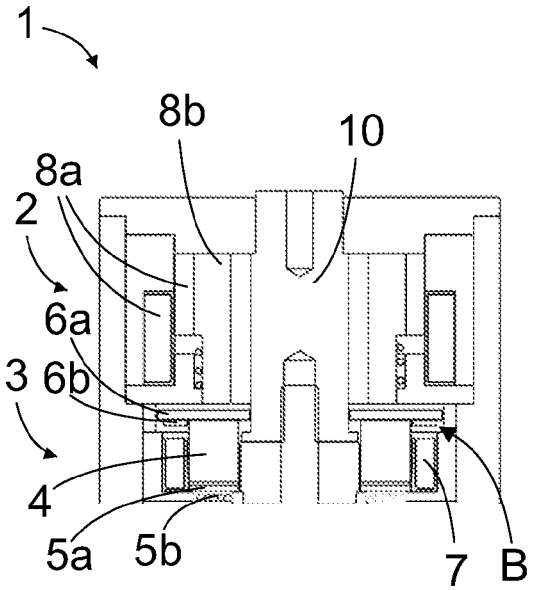
Figure 2C:
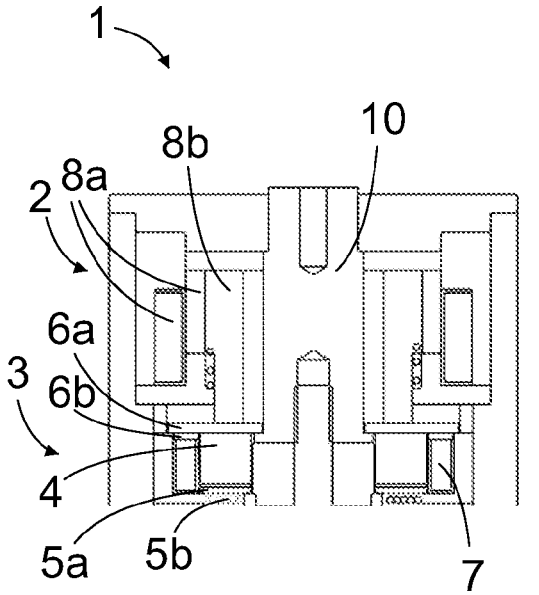

A main switch 2 according to FIGS. 1, 2*a*, 2*b* and 2*c* comprises a solenoid actuator 8 comprising a coil, a magnetic circuit and a permanent magnet. The coil can be used to enable switching the switch from open to closed state. FIG. 2*a* shows schematically a state of a switch assembly according to FIG. 1, wherein the movable contact of the contributory switch, which is the first contact 5*a*, is displaced opening the contact of the contributory switch. This provides an air gap at the arrow A, which cuts off the electric circuit at a first cut off position. The current flow in the switch assembly is explained in more detail in connection with FIG. 3. FIG. 2*b* shows schematically another state of the switch assembly, wherein this same mechanical movement related to the opening of the contact of the contributory switch, more specifically the first contact 5*a*, is provided through the flexible element 4 to open the contact of the main switch 2. An air gap is provided at the arrow B, which cuts off the electric circuit at a second cut of position. The uncompressed flexible element 4 holds the second contact 6*a* open. FIG. 2*c* shows schematically a state of the switch assembly, wherein the linear actuator 8 is closed. This can be realized, for instance, by a solenoid pushing the second contact 6*a* against connectors and permanent magnets closing the switch assembly 1. The figures, this type of an embodiment, its operational states and functionality are explained in more detail later in this description.

According to an embodiment, the contributory 3 switch may comprise a repulsive force actuator 5*a*, 5*b* for actuating a mechanical movement. The mechanical movement actuated by the repulsive force actuator 5*a*, 5*b* may be used for opening a first contact 5*a* of the contributory switch in response to a magnetic pulse.

According to an embodiment, the flexible element 4 may provide, in compressed state, a contact force between contacts of the contributory switch during a closed state of the switch assembly.

According to an embodiment, the contributory switch 3 may be coupled to the flexible element 4 such that the mechanical movement of the opening of the contributory switch is arranged to, together with the flexible element, open of the main switch 2 and to allow the flexible element to decompress so as to keep the contact of the main switch 2 in an open state, that is keeping the second contact 6*a* disconnected from at least one of connectors needed for forming a closed electric circuit. Thus, the mechanical movement of the opening of the contributory switch 3 is arranged to provide a force exceeding the holding force, which is provided by the force-providing means 7 and arranged to hold the movable contact 6*a* of the main switch 2 in position. The connectors are explained in more detail in connection with FIG. 3.

In an embodiment, the repulsive force actuator may comprise at least one movable contact, which is the first contact 5*a*. In one such embodiment, the repulsive force actuator may comprise a Thomson coil. A Thomson coil is a coil assembly, wherein rapidly changing magnetic field can be used to induce eddy current in a movable disc lying on top of the coil. Thus, the movable disc may form the first contact 5*a* and the repulsive force actuator may comprise the first contact 5*a* comprising the movable disc and the coil 5*b*. The induced current is an antiparallel to the current in the coil and, as a consequence, the magnetic force between them is repulsive. The rapid change in the magnetic field and the consequent repulsive force between the coil and the movable disc provided by the magnetic force interaction between coil current and induced current can be used to displace the movable disc away from the coil at a high speed. The same disc is used as an actuator armature and a contact element. Preferably, the disc is lightweight and thus preferably comprises a material with low density, such as aluminium. The smaller the mass of the disc is and the greater the force depending on the conductivity of the material, the faster the mechanical movement may be.

The purpose and the parameters of the application affect the appropriate material choices and a suitable design of the disc. Aluminium, for example, has been found to provide a suitable combination of mass density, conductivity and strength, which are among the most important material properties. Other materials such as copper and/or composites could be beneficial in some embodiments.

The coil 5*b* may comprise a rectangular coil wire for optimal conductor volume, but in embodiments, in which this is not critical, round or other suitable type of coil wire may be used. An advantage of this kind of a solution is that the movable contact may, thus, be formed to be very lightweight enabling higher acceleration than that of a heavier movable contact. Further advantages of the solution comprise a simple structure and the coil not having to move. In addition to this, the assembly and the flexible element are able to provide a sufficient compression on surfaces despite the light weight of the movable contact(s). Typically, the sufficient amount of compression depends on the current flowing through the switch, for example. The compression force may, in different embodiments, be adjusted by selecting a suitable length of the flexible element and a suitable degree of compression. The embodiment illustrated in FIGS. 1, 2*a*, 2*b* and 2*c*, for example, is one possible embodiment of a switch assembly comprising a repulsive force actuator with one movable contact.

Figure 4:
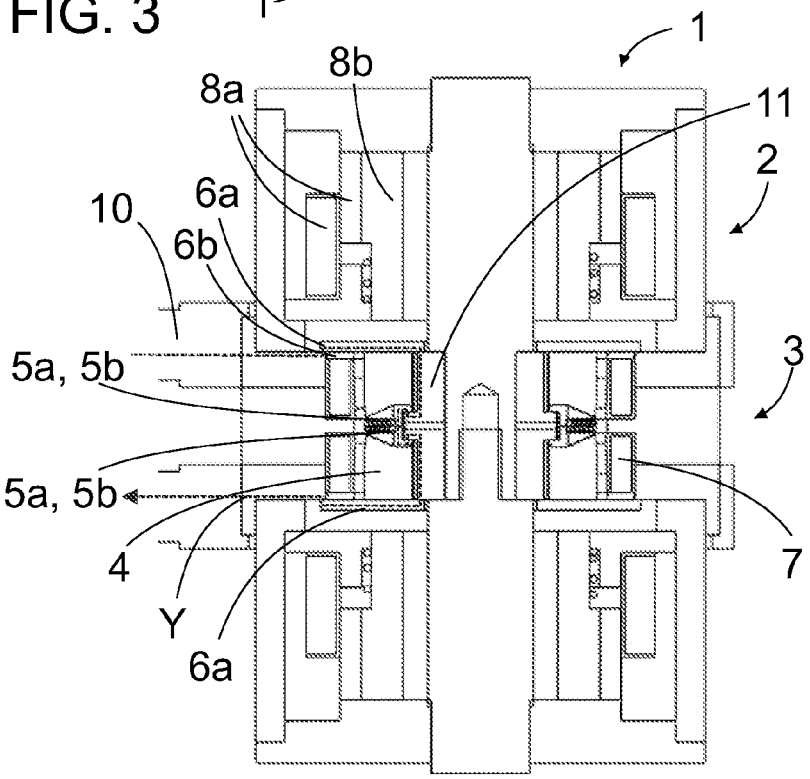
FIG. 4 is a schematic view of a switch assembly of another type used in a switch arrangement.

In another embodiment, the repulsive force actuator may comprise two movable contacts that can be made to move away from each other and open the contact. In such embodiments, each of the movable contacts may comprise a coil 5*b* and the repulsive force may be provided by providing antiparallel currents in the movable contacts facing each other. According to an embodiment, each of the two movable contacts of the repulsive force actuator may comprise a coil movable with said movable contact enabling providing a repulsive force by opposite feeding currents in the coils. In one such embodiment, the repulsive force actuator may comprise composite rings and it may be called a composite ring actuator. Each of the movable contacts may then form a first contact 5*a* and the repulsive force actuator may comprise the first contacts 5*a* and the coils 5*b* arranged to move with the first contacts 5*a*. The smaller the mass of the rings is and the greater the force depending on the conductivity of the material, the faster the mechanical movement may be. The purpose and the parameters of the application affect the appropriate design and material of the rings in a manner quite similar to that discussed in connection with the disc of the embodiment with one moving contact. By using two conducting wires with active feed, no inductive current is needed to provide the repulsive force, but the repulsive force can be provided by opposite feeding currents the coils. The material for the conductor of the movable contact comprises preferably a material that has good conductivity and a low density, such as aluminium. This enables minimizing the current needed. However, other materials, such as copper, may be used in embodiments, in which this is not of the highest importance. Preferably, the movable contacts may be formed such, for instance comprising a winged form, that they reduce or prevent forming of eddy currents. One advantage of the embodiments comprising two movable contacts comprising coils is, thus, that the embodiments also work with DC. With active feeding currents in embodiments with two movable contacts comprising coils, it is possible to achieve greater repulsive forces than with induction currents in embodiments that comprise a stationary coil and a separate movable disc that forms the movable contact. The FIG. 4 illustrates one possible embodiment of a switch assembly comprising a repulsive force actuator with two movable contacts.

In embodiments described above, it is possible to achieve an opening time of the contributory switch that is not more than 50 μs. A quick opening time is very useful in many applications, where a quick cut off of an electric circuit is important, such as in connection with preventing voltage arcs.

Preferably, the flexible element 4 connects the first contact 5*a* and the second contact 6*a* mechanically, but not electrically. In other words, current flow through the flexible element between the movable contacts of the contributory switch and the main switch is preferably prevented. The flexible element may comprise an electrically insulating material or a combination of such materials, for example. According to an embodiment, the flexible element is made of electrically insulating material. The flexible element is preferably very lightweight, which can be achieved by forming the flexible element of a material with low density, for example. On the other hand, it is desirable that the flexible element has a good shock resistance. According to an embodiment, the flexible element may comprise a cellular plastic material. This cellular plastic material may preferably be a polyurethane elastomer. This kind of a material enables forming of a light flexible element that provides the contact pressure and shock resistance needed. In other embodiments, other materials, such as rubber, may be used to form the flexible element.

According to an embodiment, the flexible element 4 may comprise a substantially cylindrical form. The first contact 5*a* and the second contact 6*a* may be arranged at opposite ends of such a substantially cylindrical flexible element.

Some operation principles of a switch assembly according to an embodiment shown in FIGS. 1 and 2*a* to 2*c*, for example, are described below. A method for switching current in an electric circuit that can be realized by said embodiment or other switch assembly or switch arrangement embodiments of this description is shown schematically in FIG. 5 and the corresponding steps are referred to below. Thus, the FIG. 1 shows a switch assembly in a closed state, which is a first stabile state of the switch assembly. Flow of electric current is enabled, in the upper half of the figure, from a main connector 10 to a contact of the main switch 6*a*, middle connector 9, contact of the contributory switch 5*a* and then through the inner connector 11 and, then, through corresponding parts in reversed order in the lower half of the figure. All contacts are closed and a linear actuator, for instance a solenoid actuator, is in its normal position. Force-providing means, such as the permanent magnet, hold the contact of the main switch in place and the flexible element is compressed holding needed contact pressure. The contributory switch can then be opened by a repulsive force actuator, in the embodiment of FIGS. 1, 2*a*, 2*b* and 2*c* more specifically the Thomson coil actuator, launching a movable contact. The flexible element is thereby compressed and the circuit is disconnected by the contact of the contributory switch. A state, where the contributory switch is opened by opening its contacts, is shown in FIG. 2*a*. Isolation is provided at least around the contact surface of the inner connector 11 such that this cuts off the current in the electric circuit. The energy of the mechanical movement of the movable contact then opens the contact of the main switch that was held in place by force-providing means, more specifically a permanent magnet in the embodiment shown in said figures. In another stabile state of the switch assembly, in which state the main contact is open, the movable contact(s) of the contributory switch lay on its place, the flexible element is in its free length and the switch assembly is in open state, is shown in FIG. 2*b*. Thus, although the contact of the contributory switch has returned to closed position, the open state of the main switch keeps the electric circuit open. Isolation is provided at least around the contact surface of the middle connector 9 such that this cuts off the current in the electric circuit. The return time of a movable contact of the contributory switch depends on a maximum compression of the flexible element. Therefore, the operating time for the main switch should not be longer than the return time. As described above, the contributory switch and the main switch are arranged in series within the switch assembly, thus enabling cutting of the electric circuit in multiple places. Thus, the electric circuit may be cut off by the contributory switch contact, the main switch contact or both at the same time.

The second contact 6*a* of the main switch can then be closed by the spring returned linear actuator, such as a spring returned solenoid actuator, for example. FIG. 2*c* shows the closing linear actuator closed. The linear actuator pushes the contact of the main switch towards the force-providing means, such as the permanent magnet, and the contact is closed and held by the force-providing means again. Thus, the switch assembly is reloaded and the electric circuit is closed again. The spring of the linear actuator returns the actuator back to its normal position. As the switch assembly has two stabile states, the state shown in FIG. 1 and the state shown in FIG. 2*b*, the switch assembly and its operation may be called bi-stabile.

In the described switch assemblies, the isolation air gap of the switch assembly is split into parts, like the air gap(s) of the contributory switch and the air gap(s) of the main switch in the state of FIG. 2*a*, with several contacts to reduce the moving distance of the contacts. This decreases the required opening speed of the first and second contacts. The speed is further improved by using lightweight movable contacts and the great moving force provided by repulsive force actuator.

To gain further benefits, two switch assemblies, that can be any switch assemblies disclosed in this description, can be coupled to one another in opposite directions to form a switch arrangement, the switch assemblies sharing a common repulsive force actuator for actuating a mechanical movement simultaneously in two opposite directions. Thus, opening a contact of each of the contributory switches can be actuated in response to a single current pulse. One advantage of such an arrangement is that recoil can be avoided, as two movable contacts are launched in opposite directions. Additionally, the isolation air gap can be split to further parts and four contacts may be arranged in series to advance fast opening and bi-stabile operation.

Figure 3:
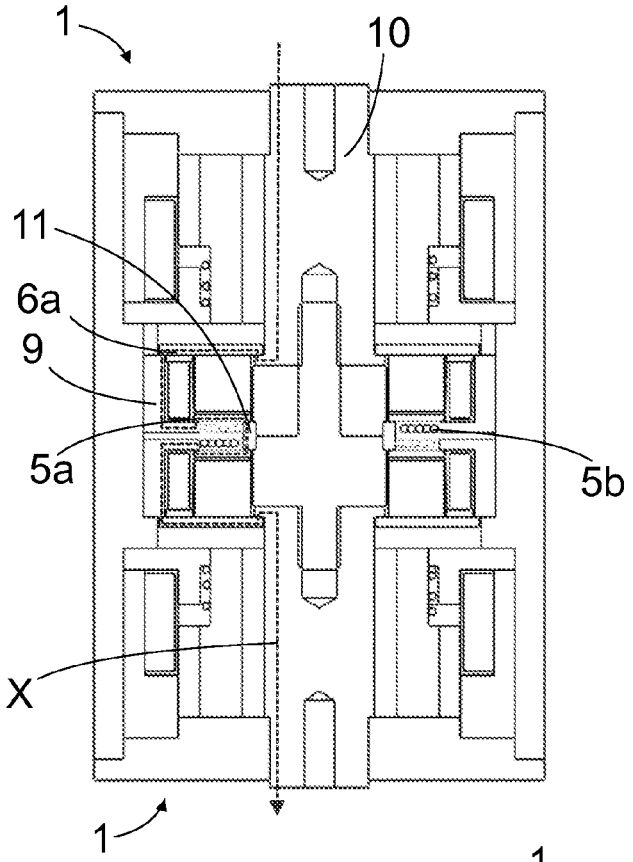
FIG. 3 is a schematic cross-sectional view of a switch arrangement and current flow in such a switch arrangement.

FIG. 3 shows schematically such a switch arrangement and the current flow in the switch arrangement is shown by dashed lines with an arrow marked with X. Current flows through the first movable contacts 5*a* and the second movable contacts 6*a* When contacts of the contributory switch and main switch are opened, four isolating air gaps are formed.

FIG. 4 illustrates schematically one example of another type of a switch assembly used in a switch arrangement, more particularly an embodiment, wherein the contributory switch comprises two movable contacts. Each movable contact, that is first contacts 5*a*, may be provided with a coil 5*b* and a repulsive force between the movable contacts may be obtained by antiparallel currents in the coils. The bistabile operation principle of this type of a switch assembly is similar to the switch assemblies with one movable contact, such as the ones described in connection with FIGS. 1, 2*a*, 2*b* and 2*c*. The difference is that the repulsive force is provided by feeding current in opposite directions to the coils of the movable contacts. This force can be used to launch the movable contacts in different directions, thus compressing the flexible element and disconnecting the circuit. Thus, the difference between these switch assembly types is that in the embodiment with one movable contact the moving part, which is the movable contact, is passive, whereas the movable parts in the switch assembly type with two movable contacts, that is the movable contacts, are active. In other words, in embodiments with at least one passive movable contact induction is exploited to obtain repulsive force, whereas in embodiments with active movable contacts this is not the case. The energy of this mechanical movement of these movable contacts then opens the contact of the main switch held by force-providing means, such as permanent magnets, just as in other described embodiments. Also otherwise the operation may be substantially similar to the other described embodiments and is thus not explained in more detail in connection with this embodiment. A further difference between switch arrangements realized with switch assemblies comprising at least one passive movable contact and switch assemblies comprising active movable contacts is that in an arrangement of the latter type only three air gaps may be formed instead of the four air gaps formed in the first type. This difference is, however, compensated by the greater moving forces and faster moving speeds of the switch arrangement with switch assemblies comprising two movable contacts each comprising a coil movable with the movable contact. In the FIG. 4, current flow in the switch arrangement is shown by dashed lines with an arrow and marked with Y. The principles are mainly same as those described in connection with the embodiment of FIGS. 1 to 3, but in this embodiment the nominal current can be provided in the middle of the arrangements rather than at the ends. On the other hand, this means that no middle connectors are needed, but the current flows from the main connector 10 to the second contact 6*a*, then through the inner connector 11 to the first contact 5*a* and, then, through corresponding parts in reversed order in the lower half of the figure.

Figure 5:
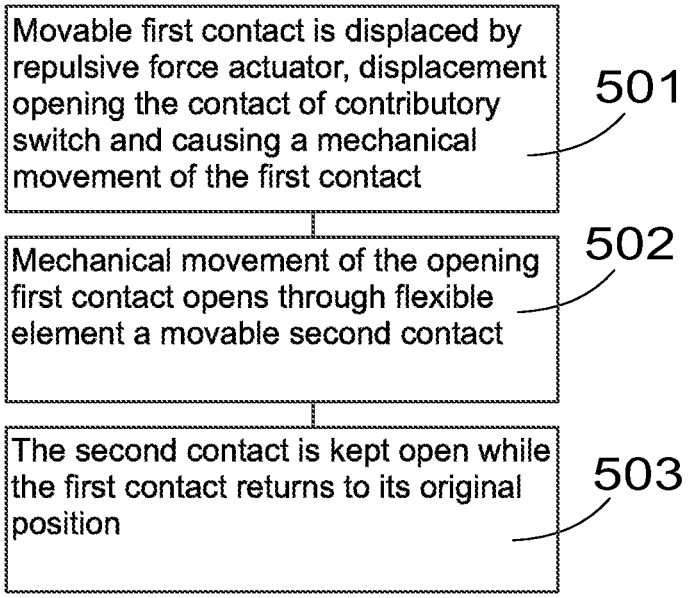
FIG. 5 shows schematically a method for switching current in an electric circuit.

FIG. 5 shows schematically a method for switching current in an electric circuit. A movable first contact is displaced 501 by a repulsive force actuator such that the displacement opens the contact of the contributory switch and causes a mechanical movement of the first contact. Mechanical movement of the opening first contact then affects 502, through the flexible element, opening of a movable second contact, thus opening the contact of the main switch. The second contact is kept 503 open thus keeping the contact of the main switch open, while the first contact returns to its original position and to a conductive state.

According to an embodiment, a switch assembly may comprise a contributory switch and a main switch connected electrically in series, wherein movable contacts of each switch are mechanically connected to each other by a flexible element. A method of switching an electric circuit by such a switch assembly may comprise opening the contributory switch such that the flexible element becomes compressed, whereby the decompression of the flexible element is arranged to cause opening of the main switch.

It is clear for a skilled person that a switch assembly and/or a switch arrangement may comprise other components and/or structural parts besides the ones described in this description. These may comprise but are not limited to, frame and heat insulation structures, for example.

A switch assembly or switch arrangement described above has several benefits over known switches. Such a switch assembly or arrangement, preferably connected in parallel with a varistor to absorb the inductive energy and/or a semiconductor switch arrangement to conduct electricity until a sufficient air gap is provided the switch assembly or switch arrangement, is beneficial for instance in an electric circuit, where voltage are need to be avoided when breaking the circuit, as such an arrangement can combine a very fast switching cutting off a short-circuit current quickly and at the same time provides sufficient air gap to avoid an arc from being formed as the switch closes.

It will be obvious to a person skilled in the art that, as the technology advances, the inventive concept can be implemented in various ways. The invention and its embodiments are not limited to the examples described above but may vary within the scope of the claims.

The invention claimed is:

1. A switch assembly for switching an electric circuit, wherein the switch assembly, wherein the switch assembly comprises:

a contributory switch;

a main switch; and a flexible element, wherein the contributory switch and the main switch are connected electrically in series, the contributory switch and the main switch each comprise at least one movable contact and the flexible element is connected to one movable contact of the contributory switch, a first contact, and one movable contact of the main switch, a second contact, and wherein opening of the contributory switch is arranged to compress the flexible element and the decompression of the flexible element is arranged to cause opening of the main switch.

2. A switch assembly according to claim 1, wherein the contributory switch comprises a repulsive force actuator for actuating a mechanical movement opening a contact of the contributory switch in response to a magnetic pulse.

3. A switch assembly according to claim 1, wherein a flexible element provides, in a compressed state, a contact force between contacts of the contributory switch during a closed state of the switch assembly.

4. A switch assembly according to claim 1, wherein the contributory switch is coupled to the flexible element such that the mechanical movement of the opening contributory switch is arranged to, together with the flexible element, open of the main switch and to allow the flexible element to decompress so as to keep the contact of the main switch in an open state.

5. A switch assembly according to claim 2, wherein said repulsive force actuator comprises one movable contact.

6. A switch assembly according to claim 5, wherein the repulsive force actuator comprises a Thomson coil.

7. A switch assembly according to claim 2, wherein said repulsive force actuator comprises two movable contacts.

8. A switch assembly according to claim 7, wherein each of the two movable contacts of the repulsive force actuator comprises a coil movable with said movable contact enabling providing a repulsive force by opposite feeding currents in the coils.

9. A switch assembly according to claim 1, wherein the flexible element comprises a cellular plastic material.

10. A switch assembly according to claim 1, wherein the main switch comprises a spring-return solenoid actuator for closing the contact of the main switch.

11. A switch assembly according to claim 1, comprising force-providing means for providing, in a closed state, a contact force for the contact of the mains switch and a compressive force for the flexible element.

12. A switch assembly according to claim 11, wherein the force-providing means comprise at least one of the following: a permanent magnet and an electric magnet.

13. A switch assembly according to claim 1, wherein a movable first contact and a movable second contact connect, in a closed state, two connectors of the switch assembly such that when one of the movable contacts is opened, two air gaps are arranged to be formed, one air gap at each end of the movable contact, wherein the two connectors comprise at least two of the following: a main connector, a middle connector and an inner connector.

14. A switch arrangement, wherein two switch assemblies according to claim 1 are coupled to one another in opposite directions.

15. A switch arrangement according to claim 14, wherein the two switch assemblies share a common repulsive force actuator actuating a mechanical movement simultaneously in two opposite directions and thus opening a contact of each of the contributory switches in response to a single magnetic pulse.

16. A method of switching an electric circuit by a switch assembly, wherein the switch assembly comprises a contributory switch and a main switch, which are connected electrically in series, and where movable contacts of each switch are mechanically connected to each other by a flexible element, and by the method comprising:

opening the contributory switch such that the flexible element becomes compressed, whereby the decompression of the flexible element is arranged to cause opening of the main switch.

* * * * *